US005926982A

United States Patent [19]

Keech et al.

[11] Patent Number: 5,926,982

[45] Date of Patent: Jul. 27, 1999

[54] HYDRAULIC FASTENING DEVICE AND METHOD

[75] Inventors: Garth Alexander Keech, Galdersville; David Kim Keech, Castle Hill, both of Australia

[73] Assignee: Keech Castings Australia Pty. Limited, Mascot, Australia

[21] Appl. No.: 08/809,539

[22] PCT Filed: Sep. 16, 1994

[86] PCT No.: PCT/AU94/00555

§ 371 Date: Jun. 20, 1997

§ 102(e) Date: Jun. 20, 1997

[87] PCT Pub. No.: WO96/08612

PCT Pub. Date: Mar. 21, 1996

[51] Int. Cl.[6] ..... E02F 9/28

[52] U.S. Cl. ..... 37/455; 37/458

[58] Field of Search ..... 37/451, 452, 453, 37/454, 455, 456, 458; 172/772, 772.5, 713, 753, 751, 272; 403/31, 34, 37, 379.5, 379.6, 317

[56] References Cited

U.S. PATENT DOCUMENTS

| | | | |
|---|---|---|---|
| 3,891,065 | 6/1975 | Iijima et al. | 172/272 X |
| 4,067,657 | 1/1978 | Kaarlela | 403/317 |

FOREIGN PATENT DOCUMENTS

| | | |
|---|---|---|
| 29809/71 | 6/1972 | Australia . |
| 34417/71 | 4/1973 | Australia . |
| 70747/81 | 11/1981 | Australia . |
| 80818/82 | 9/1982 | Australia . |
| 521560 | 1/1993 | European Pat. Off. . |
| 531603 | 3/1993 | European Pat. Off. . |
| 555566 | 8/1993 | European Pat. Off. . |
| 93/05245 | 3/1993 | WIPO . |

*Primary Examiner*—Thomas B. Will
*Assistant Examiner*—Robert Pezzuto
*Attorney, Agent, or Firm*—Darby & Darby

[57] ABSTRACT

A hydraulic fastening device, for securement of two components, for example, securement of teeth to a bucket on earthmoving or mining equipment. Each component has an orifice therein adapted to be substantially aligned. A body member is inserted in the aligned orifices. A control device is then operated to move at least one protrusion to protrude from the body and to fasten the components. This is achieved by hydraulic operation and connection of a fluid conduit between the control device, e.g. a grease nipple, and the protrusions.

10 Claims, 8 Drawing Sheets

HYDRAULIC FASTENING DEVICE AND METHOD

BACKGROUND OF THE INVENTION

The present invention relates to a hydraulic fastening device and method, and in particular to such a device and method useful in the mining or earthmoving industry for attaching teeth or wear plates to bucket drag lines of such implements and the like.

The present invention is however useful for attaching any two components together which might normally be joined by some form of mechanical joining mechanism, such as bolts, screws, or welds.

DESCRIPTION OF THE PRIOR ART

There are in existence different methods of using wedge and spool assemblies for connecting implements such as teeth and/or adaptors to drag lines buckets and the like which methods include that described in the applicant's International PCT Patent Application No. PCT/AU94/00035. That application discloses a spool and wedge assembly which comprises an array of wedges which co-operate to enable secure fitting of teeth to the buckets.

In the heavy earthworks industry, buckets attached to heavy earthmoving equipment are adapted with leading edge implements for cutting or moving overburden. These implements, commonly referred to as teeth, must by necessity be replaceable due to heavy wear and tear.

Teeth are generally fixed to a bucket in one of two ways. In the case of smaller buckets the teeth are detachably fixed directly to an adaptor formed integral with the bucket generally known as a bucket nose. In the case of the larger buckets the teeth are fitted via an adaptor which attaches to a specifically configured formation in the bucket leading edge. The teeth and adaptors are subjected to heavy wear and must be regularly replaced with the life of the teeth and adaptor generally dictated by the nature of over burden that the bucket is required to move. In the case of drag lines the wear is significant. According to the prior art the teeth are generally wedge shaped and attach to the leading edge of the adaptor by pin encapsulation, the pin connecting the spool and wedge assembly.

The adaptor mates at its trailing end to the bucket leading edge. At present, this particular attachment is effected by a known spool and wedge, assembly which comprises a generally elongated truncated cylindrical spool and a wedge which mutually cooperate to secure the adaptor to the bucket. Buckets usually have a multiplicity of such spool and wedge assemblies spaced apart along the leading edge of the bucket generally commensurate with the number of teeth on the bucket. In the case of large buckets there could be half a dozen or more assemblies which require constant replacement.

Not only do these assemblies require replacement after excessive wear, they also require constant monitoring during use to ensure that they do not become sloppy and loose thereby inhibiting the efficiency of the operation of the teeth.

Presently, according to one method, in order to fit the wedge and spool assembly, the wedge and spool are placed into recesses formed in both the adaptor and bucket, which are aligned when the adaptor is fitted to the bucket. When the adaptor is fitted to the bucket, this recess is axially aligned. The wedge element is then driven home axially by a sledge hammer, to secure the adaptor to the bucket. A tight fit is ensured by jamming the wedge against the spool. At present, the spool and wedge assembly extends axially downwardly beyond the periphery of the underside of the adaptor and bucket. The extension engages the ground during use of the bucket and causes the adaptor to become loose as the wedge and spool work loose. This occurs particularly in circumstances where the bucket is used to excavate hard and rocky ground. Personnel are employed to regularly check the integrity of the connection of the adaptor. Where the fit works loose, due to movement of the wedge and spool assembly, it must be constantly hammered to tighten the connection. This is a labour intensive and physically demanding activity. Likewise, when a spool and wedge assembly is to be released to free the adaptor from the bucket the assembly must be violently hammered to remove it and generally from underneath the bucket. For this purpose the bucket must be lifted up to enable a labourer to gain access to the distal end of the assembly. Due to the intensely physical nature of this work, many men are required to fit and remove the adaptors and to check and ensure tightness of the fit.

According to the prior art methodology, trades people, such as fitters, are employed to fit the spool and wedge assemblies to the buckets. The spool and wedge assembly is inserted into the recess in the implement to be fitted to the bucket. The wedge is hammered with a sledge hammer to drive the wedge home. Once a tight fit is achieved the bucket is used a small number of times and then rechecked. If loosening occurs the fitter drives the wedge in even further until it is tight enough to allow continued operation of the bucket. At that time any part of the wedge and spool assembly which extends beyond the extremity of the implements fitted to the bucket are removed by means of an oxy acetylene cutter.

The difficulty with removing the head piece and tail piece of the wedge and spool assembly is that if it again becomes loose it is difficult for the fitter to hammer the top of the wedge as it is flush with the surface of the implement fitted to the bucket.

Also, when an implement such as a tooth is finally worn out it can sometimes be so difficult to remove the spool and wedge assembly that it is necessary to cut through the old tooth or adaptor in order to remove the assembly. This clearly adds to the cost of fitting and maintaining the prior art wedge and spool assemblies.

The applicant has previously addressed this problem, one solution to which has been made the subject of aforesaid International PCT Patent Application No. PCT/AU94/00035. That application discloses an alternative form of spool and wedge assembly, and comprises a spool and wedge assembly for use in connecting an implement to the nose of an earth moving bucket. The spool and wedge assembly comprises first and second spools, first and second wedges, and, a bolt assembly for joining the first and second wedges. When the bolt is turned in one direction the wedges are drawn towards each other thereby urging the spools apart and against the wall of a recess in which said spool and wedge assembly is placed thereby securing said implement to said bucket. As an alternative to the bolt assembly a threaded shank with a hexagonal nut may be used.

That invention has major advantages over the prior art particularly in its facility for convenient releasable attachment of implements to the buckets.

SUMMARY OF THE INVENTION

The present invention seeks to provide a further alternative to the applicant's own previous invention and in doing so to ameliorate the aforesaid disadvantages.

The present invention seeks to provide a convenient method for fitting, adjusting and/or removing a wedge and spool assembly.

The invention also seeks to provide a wedge and spool assembly adapted for ease of fitting, adjustment and release of a tooth or like implement and/or adaptor from an earthmoving bucket.

In one broad form, the present invention provides a hydraulic fastening device, for securement of two components, each component having an orifice or cavity at least partly therethrough adapted to be substantially coaxially aligned, said fastening device comprising:

a substantially elongate body member adapted to be inserted substantially within said orifice or cavity of each component when substantially coaxially aligned;

a fluid conduit within said body member containing a fluid therein;

at least one movable protrusion means in contact with said fluid, adapted to protrude in a substantially transverse direction from said elongate body member; and, control means to control the movement of said at least one protrusion;

such that, upon operation of said control means, said at least one protrusion is moved to a protruded position to fasten said two components.

Preferably, said control means is a valve mechanism to permit the ingress/egress of fluid to/from said fluid conduit, such that, upon the ingress of fluid, said protrusion(s) protrude from said body member, and, upon the egress of fluid, said protrusion(s) retract within said body member.

Alternatively, but also preferably, said control means comprises a piston device, such that, when said piston device is actuated, a compressive force is applied to said fluid to cause said protrusion(s) to protrude from said body member, or, a decompressive force is applied to said fluid to cause said protrusion(s) to withdraw into said body.

In a preferred form of the invention a first of said components is a bucket or other component of an earthmoving or mining equipment, or the like; and, a second of said components is one or more teeth, adaptors or the like, to be attached to said earthmoving or mining equipment, or the like.

In a further preferred form said first component is embodied as an outwardly projecting member and is provided with a transverse orifice therethrough; and, said second component is of complementary shape with a hollow centre portion, adapted to substantially surround said projecting member such that orifice(s)/cutout(s) provided on either side thereof are adapted to be substantially axially aligned with said orifice of said first component;

such that, when said orifice(s)/cutout(s) of said components are substantially aligned, said body member may be inserted and fastened therein.

Perhaps most preferably said body member is substantially cylindrical in shape.

In a further broad form, the present invention provides a method of fastening two components, wherein each of said components are of complementary shape and are provided with an orifice and/or cutout therein, comprising the steps of:

positioning said two components such that their respective orifice(s)/cutout(s) are substantially aligned;

inserting a fastening device within said joined orifice(s)/cutout(s), characterised in that said fastening device comprises a substantially elongate body member provided with a fluid conduit, at least one protrusion means, and control means to hydraulically control the movement of said protrusion means;

operating said control means such that said protrusion means extends substantially transversely of said body member such that said components become substantially fastened.

BRIEF DESCRIPTION OF THE DRAWINGS

The present invention will become more fully understood from the following detailed description of preferred but non-limiting embodiments thereof, described in connection with the accompanying drawings, wherein.

DETAILED DESCRIPTION OF THE PREFERRED EMBODIMENTS

Figure 1:
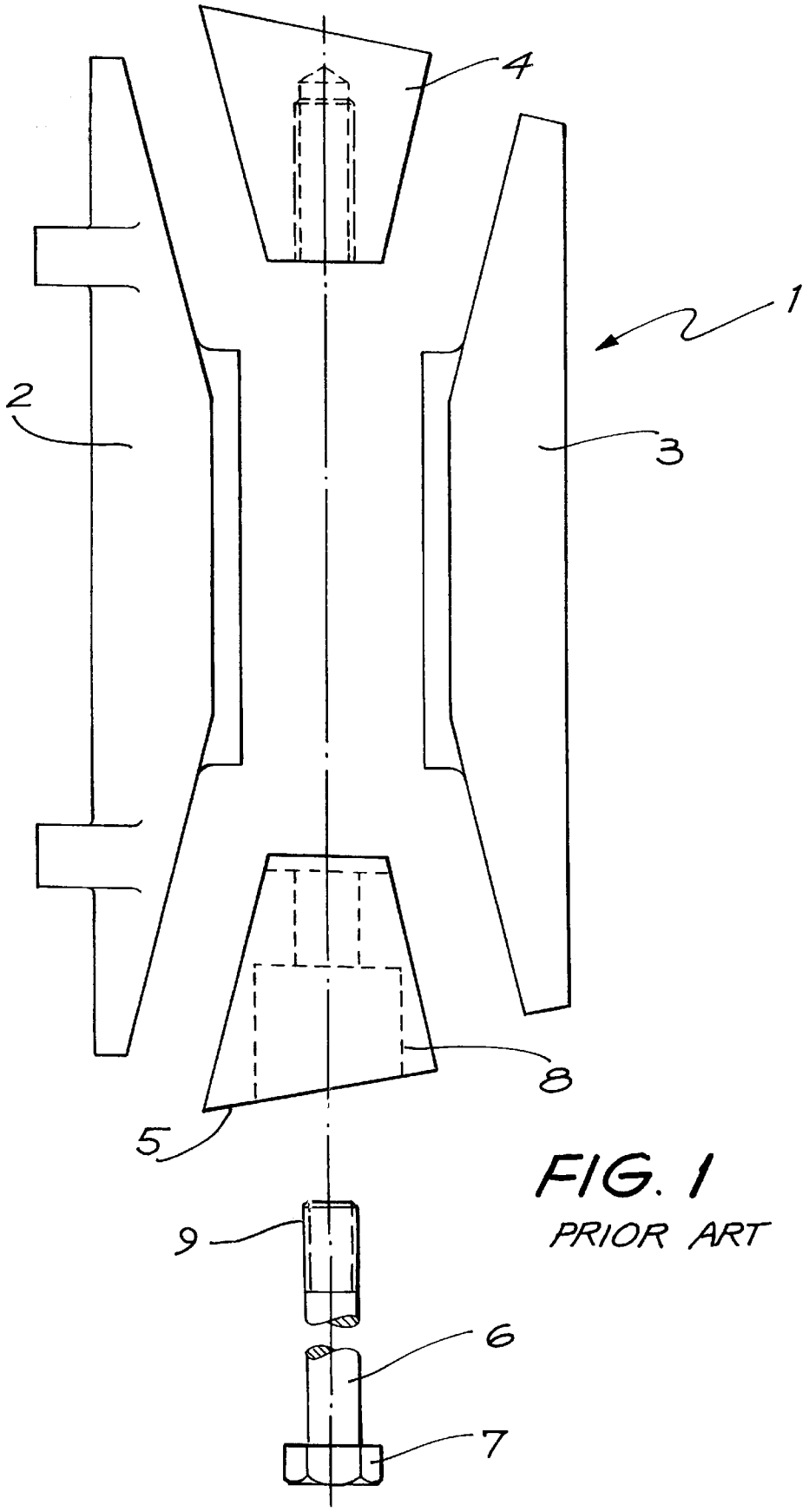
FIG. 1 PRIOR ART
FIG. 1 shows an exploded view of a prior art spool and wedge assembly.
Figure 2:
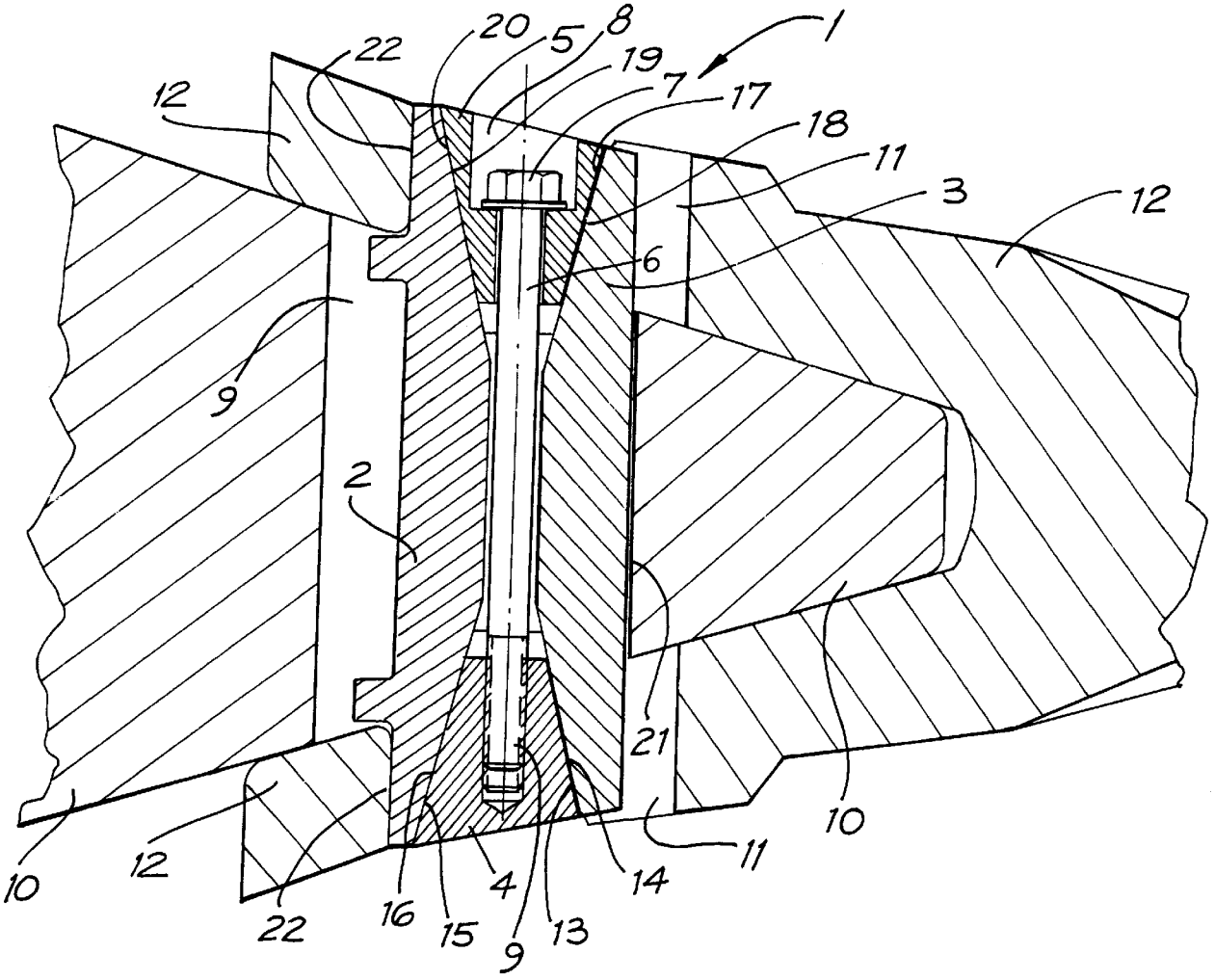
FIG. 2 PRIOR ART
FIG. 2 shows a cross sectional view of the prior art device, in an assembled manner.

Referring to FIG. 1 and 2 there is shown cross sectional views of the applicant's prior art spool and wedge assembly 1, FIG. 1 showing an exploded view, and FIG. 2 showing the device in assembled form. The assembly comprises first and second opposing spool members 2 and 3 respectively, and includes first and second wedge members 4 and 5 linked by means of bolt 6. Bolt 6 is adapted with hexagonal head 7 which preferably fits within recess 8. Bolt 6 also has threaded portion 9 which threadably engages first wedge member 4.

FIG. 2 shows a cross sectional assembled view of the assembly 1 fitted within a passage 9 in bucket nose 10. Passage 9 aligns with passage 11 in adaptor 12. Passages 9 and 11 are substantially in axial alignment when the adaptor is properly fitted to the bucket nose 10. When an adaptor is to be fitted to the bucket nose 10, the passages are first aligned so as to enable feeding therein of assembly 1 in a loosely assembled form. When the assembly 1 is in position, the user rotates head 7 of bolt 6 in a first direction which urges wedges 4 and 5 towards each other. When the assembly 1 is in position the wedges 4 and 5 abut spools 2 and 3. Contact between wedge 4 and spools 2 and 3 takes place via abutment of surface 13 against surface 14 and abutment of surface 15 against surface 16. Similarly, contact between wedge 5 and spools 2 and 3 takes place via abutment of surface 17 against 18 and surface 19 against 20. The camming action generated between the aforesaid contacting surfaces induces a wedging effect and urges spools 2 and 3 in opposing directions and against the wall 21 in the case of bucket nose 10 and wall 22 in the case of adaptor 12 of passages 9 and 11 respectively.

Figure 3:
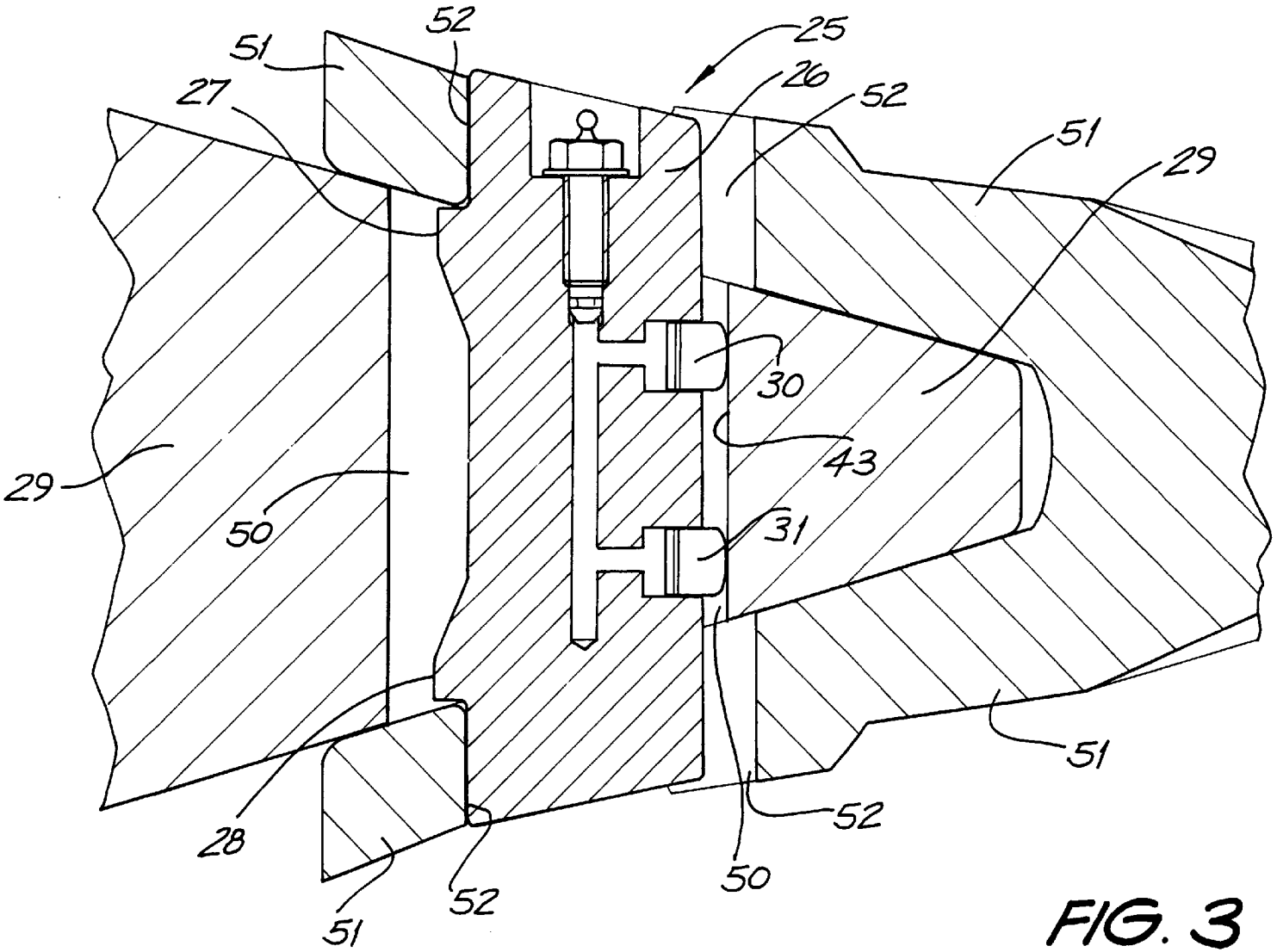
FIG. 3 shows a cross sectional view of the fastening device according to a preferred embodiment of the invention in assembled form.

Referring to FIG. 3 there is shown a cross sectional view of an alternative fastening arrangement 25 according to a preferred embodiment of the invention. The preferred embodiment in the invention will be described according to its use as a hydraulic wedge assembly as an alternative device to the spool and wedge assembly of FIGS. 1 and 2. It should be appreciated that the hydraulic fastening device is adaptable to a wide variety of applications far beyond replacement of a prior art mechanical spool and wedge device.

Assembly 25 generally comprises a substantially elongate body member 26 adapted to be inserted substantially within orifices or cavities of the pair of components. In the illustrated embodiment of FIG. 3, a first of the components is an outwardly projecting member 29 provided on a bucket or other component of an earthmoving or mining equipment. Component 29 is provided with an orifice 50 transversely therethrough. The second component is a complementary shaped component 51 which is adapted to be secured to the first component 29. A second component 51 is adapted to substantially surround the projecting member 29, and is also provided with an orifice 52 therethrough. The orifice 52 is adapted to substantially coaxially align with the orifice 51 such that the fastening device may be inserted therein. As will be seen, when the first component 29 is substantially aligned with the second component 51, the body member 25 may be inserted therein, as shown in FIG. 3.

Figure 4:
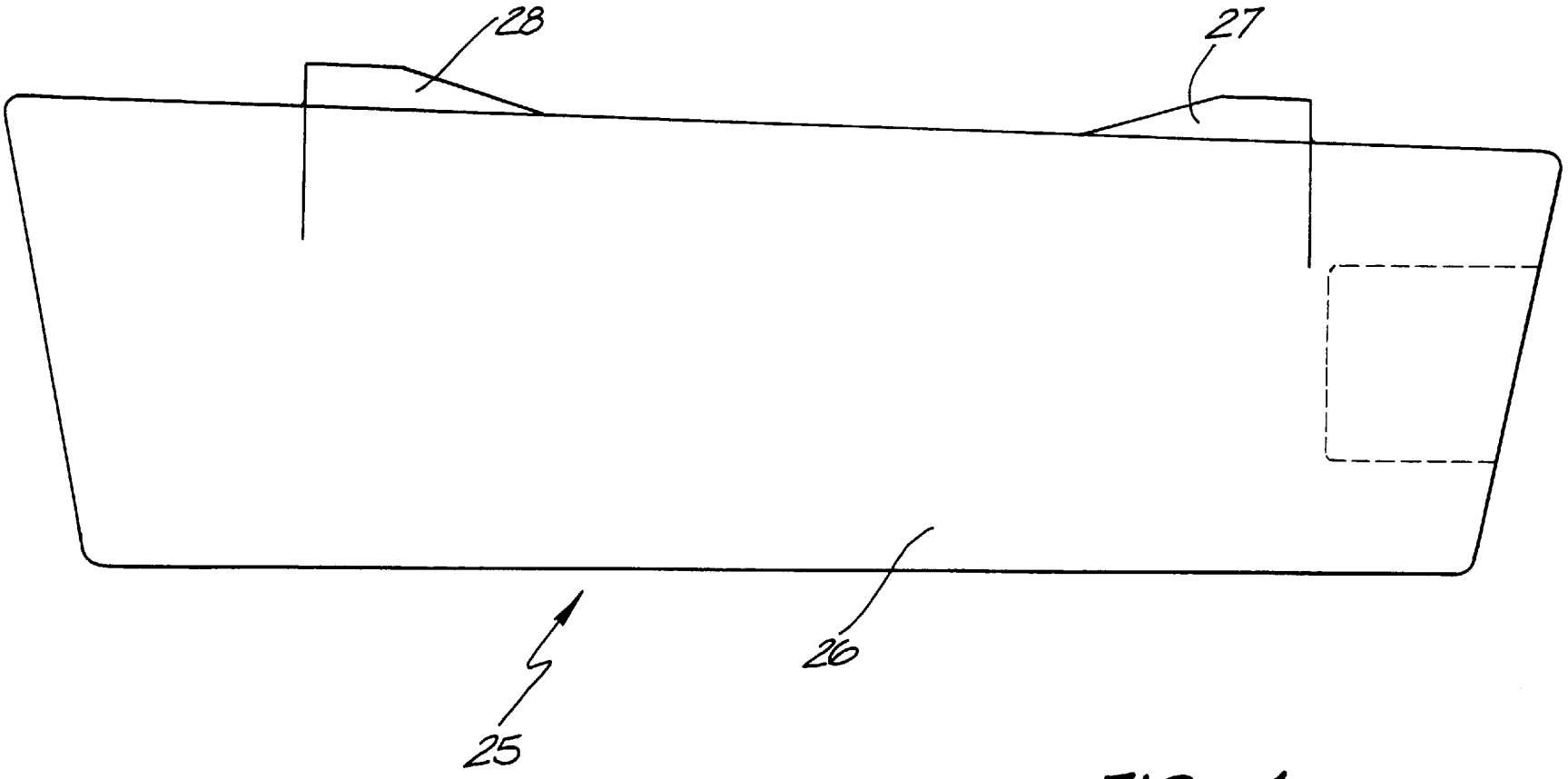
FIG. 4 shows a side elevational view of the body member of the fastening device.
Figure 5:
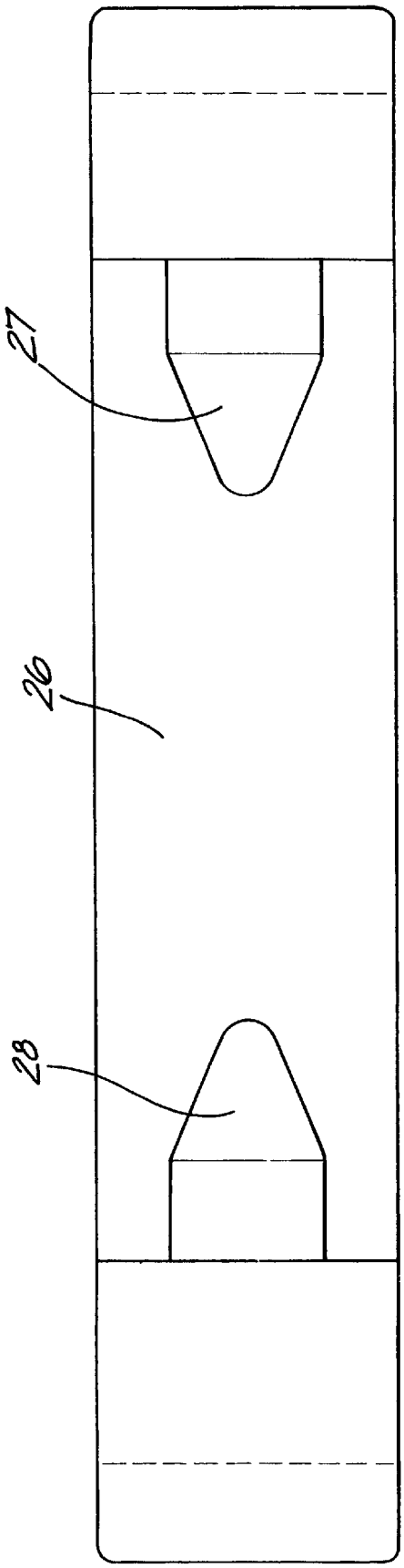
FIG. 5 shows a side elevational view of the body member of the device, rotated 90 degrees.

FIG. 4 shows a side view of the device 25, whilst FIG. 5 shows another side of it, rotated through a 90° angle.

Figure 6:
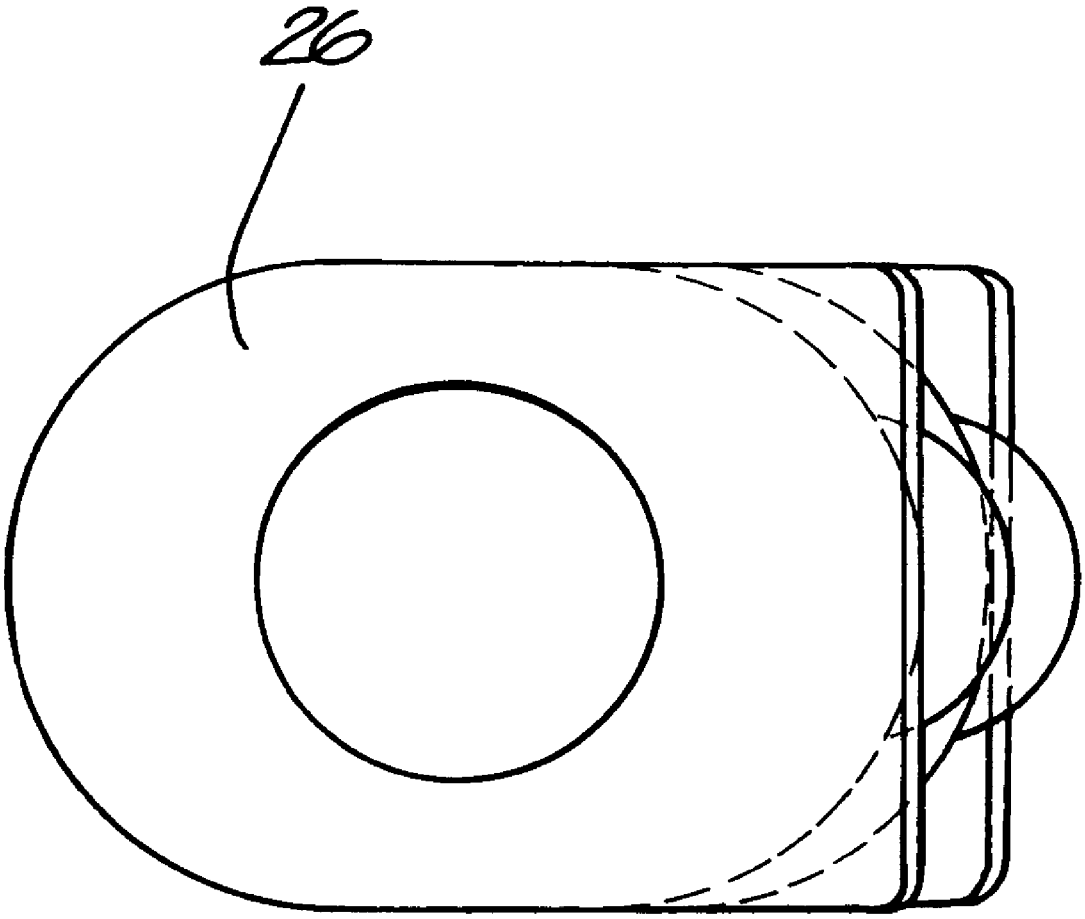
FIG. 6 shows an end view of the device.
Figure 7:
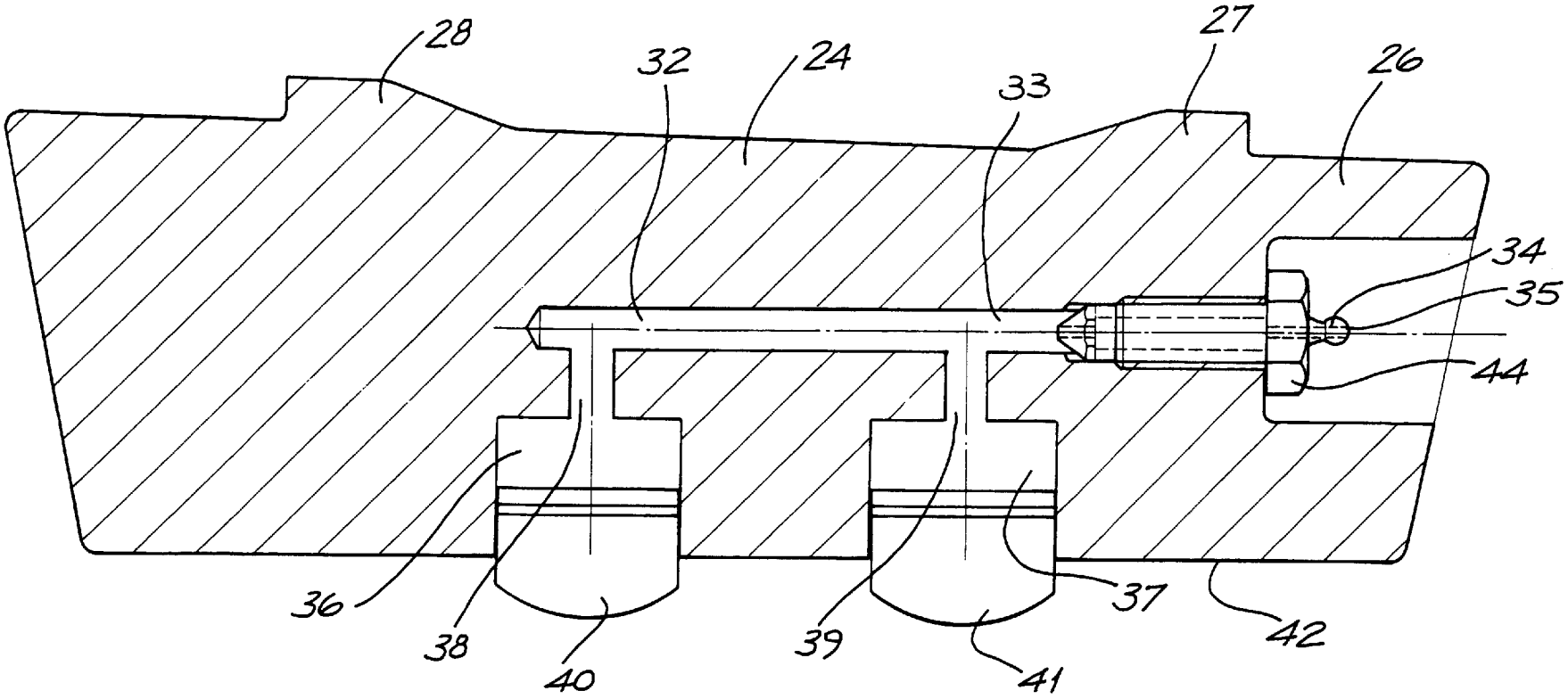
FIG. 7 shows a cross sectional view of the device, detailing the fluid conduit; and, FIG. 8 shows the piston like movable protrusion means and associated sealing rings which act in fastening the device.
Figure 8:
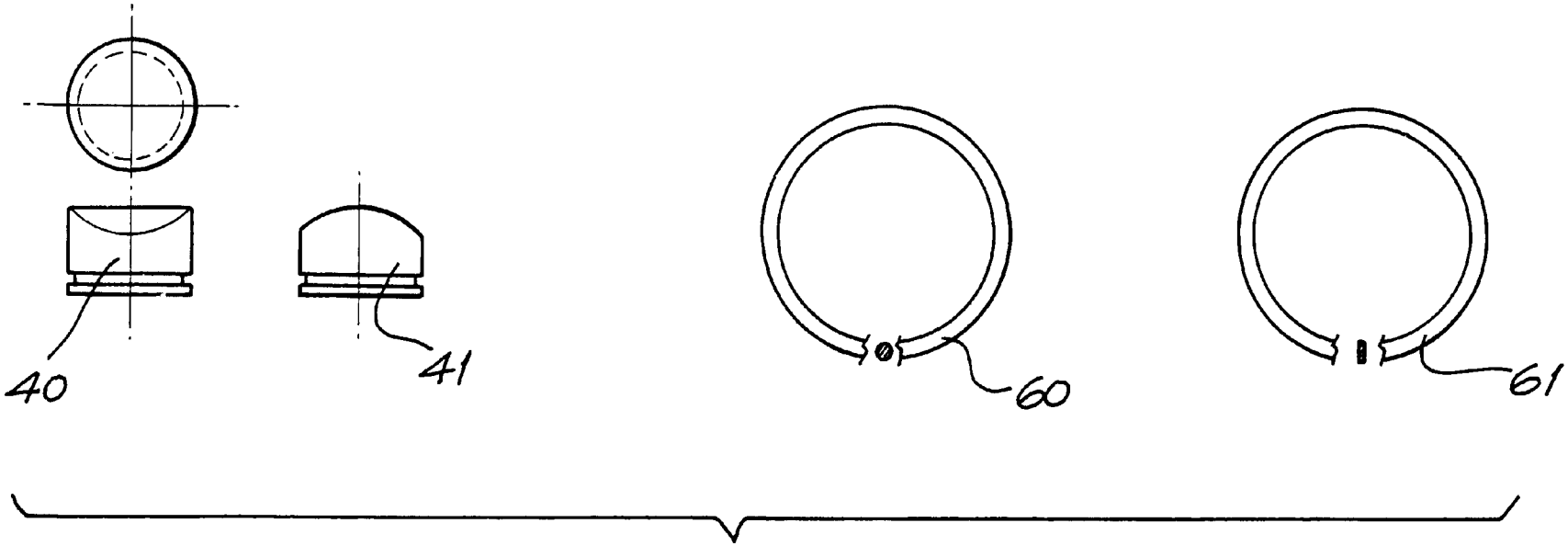

FIG. 6 shows an end view of the device of FIG. 3 to 5. FIG. 7 shows a cross-sectional view of the device, and FIG. 8 shows details of the projection members and sealing means, of the fastening device.

The operation of the hydraulic fastening device will now be described in relation to FIG. 7. As the cross-sectional view of FIG. 7 shows, the device 26 is provided with a fluid conduit 32 therein, formed by a central cavity or channel 33, a pair of channels 38 and 39 leading to chambers 36 and 37, respectively. The fluid conduit and the chambers are adapted to receive grease or other fluid substance therein. In the case of grease, a grease nipple 34 is provided to permit the ingress or egress of grease to and from the conduit 32. A pair of pistons or protrusion members, such as detailed in FIG. 8 and shown by reference numerals 40 and 41, are adapted to be provided within the chambers 36 and 37 and be movably displaced in a direction transverse to the longitudinal direction of the body member 26. The piston or protrusion members 40 and 41 are provided with suitable O-ring type seals or the like to ensure that good movement of the pistons 40 and 41 is enabled without the loss of fluid from within the fluid conduit. Suitable type rings are shown in FIG. 8 and illustrated by the numerals 60 and 61.

The actuation of the pistons or protrusion members 40 and 41 will now be described in relation to this application to earth moving or mining equipment.

When an element such as a tooth or adaptor is to be fitted to an earth moving bucket, the main body member 26 is provided to within the recess or orifice formed between the two components 29 and 51. Once the main body member 26 is in position, a grease gun is attached to the nipple 35, and grease is supplied to within the fluid conduit 32, such that pistons 40 and 41 which fit snugly within the cavities 36 and 37 are urged beyond the periphery 42 of the body member 26. Depending upon how much grease is supplied to within the fluid conduit 32, the pistons 40 and 41 may be advanced to a further or lesser distance. By way of example, the pressure required to advance the piston the small distance required to effect wedging of the fastening device between the two components in accordance with the preferred arrangement of the present invention, may typically be within the range of 5 psi to 1,000 psi. The distance of travel of the pistons to effect wedging would be typically of the order of 10–12 mm, but could be between 5 and 50 mm. Obviously, the pressure and distance travelled will vary depending upon the particular application of the invention.

When the fastening device 26 is to be released, for example, when the implement attached to the bucket is to be removed for replacement, the grease nipple may be rotated such that the pressure within the fluid conduit is reduced enabling the pistons 40 and 41 to be retracted to within the cavities 36 and 37. Thereafter, the embodiment 26 is able to be released from the cavities or orifices.

The present invention has the advantage of reduced weight compared to the prior art devices and ease of insertion and release from its work sites. The physical effort required to remove the spool and wedge assembly is dramatically reduced and little or no sledge hammering is required. A large mechanical advantage is obtained in use of the hydraulic assembly to induce the friction forces in the recess rather than relying on the strength of a sledge hammer blow to achieve the same friction effect as was the case with the prior art.

It will of course be recognised by persons skilled in the art that numerous variations and modifications may be made to the invention. For example, whilst the present invention has been particularly described in relation to a particular fastening arrangement useful for attaching wear teeth to an earth moving bucket, the device may be equally as well used for fastening any other two components together, from domestic household commercial use, etc. For example, wherever substantially aligned holes are drilled or otherwise supplied in two components, and those components are intended to be fastened together, the fastening device may be used. It will be appreciated that a particular advantage of the fastening device of the present invention is that the provision of compression or additional fluid material to the device is easily supplied by known means, and likewise pressure or additional fluid may be released from the device by likewise known devices.

The utilisation of a hydraulic mechanism eliminates disadvantages with known mechanical fastening methods and devices. There is often a relationship between the physical strength of the person supplying the mechanical fastening device into position Obviously also, the shape and configuration of the device will obviously be able to be varied to a large extent. The number, size and shape of the protrusions may also vary to a large extent.

Accordingly, it will be appreciated to persons skilled in the art that numerous variations and modifications to the invention will become apparent. All such variations and modifications should be considered to fall within the scope of the invention as broadly described hereinbefore and as claimed hereinafter.

We claim:

1. A hydraulic fastening device, for securement of two components, each component having an orifice or cavity at least partly therethrough adapted to be substantially coaxially aligned, said fastening device comprising:

a substantially elongate body member adapted to be inserted substantially within said orifice or cavity of each component when substantially coaxially aligned;

a fluid conduit within said body member constructed to contain a fluid therein;

at least one movable protrusion means in contact with said fluid, when present, constructed to protrude in a substantially transverse direction from said elongate body member under the influence of said fluid;

a fitting adapted to be connected to a source of fluid and a passageway extending from said fitting into said fluid conduit; and control means in said device controlling the movement of fluid between said passageway and said conduit;

such that, upon operation of said control means, said at least one protrusion is moved to a protruded position to fasten said two components.

2. A hydraulic fastening device as claimed in claim 1, wherein said control means is a valve mechanism which controls the movement of fluid so that, upon the ingress of fluid, said protrusion protrudes from said body member, and upon the egress of fluid, said protrusion retracts within said body member.

3. A hydraulic fastening device as claimed in claim 1 wherein:

a first of said components is a component of an earthmoving or mining equipment, and, a second of said components is at least one tooth adaptor, to be attached to said earthmoving or mining equipment.

4. A hydraulic fastening device as claimed in claim 3, wherein said body member is substantially cylindrical in shape.

5. A hydraulic fastening device as claimed in claim 3, wherein:

said first component is embodied as an outwardly projecting member and is provided with a transverse orifice therethrough; and, said second component is of complementary shape with a hollow centre portion, adapted to substantially surround said projecting member, said component orifices or cavities are provided on either side thereof and are adapted to be substantially axially aligned with said orifice of said first component;

such that, when said orifices of said components are substantially aligned, said body member may be inserted and fastened therein.

6. A hydraulic fastening device as claimed in claim 5, wherein said body member is substantially cylindrical in shape.

7. A hydraulic fastening device, for securement of two components, each component having an orifice or cavity at least partly therethrough adapted to be substantially coaxially aligned, said fastening device comprising:

a substantially elongate body member adapted to be inserted substantially within said orifice or cavity of each component when substantially coaxially aligned:

a fluid conduit within said body member containing a fluid therein;

at least one movable protrusion in contact with said fluid, constructed to protrude in a substantially transverse direction from said elongate body member under the influence of said fluid;

a pressurizing device in said fastening device actuable to apply a compressive force to said fluid to cause said protrusion to protrude from said body member, said protrusion withdrawing into said body when said force is removed.

8. A hydraulic fastening device as claimed in any one of claims 1, 2 or 7 wherein said body member is substantially cylindrical in shape.

9. A method fastening two components, wherein each of said components are of complementary shape and are provided with an orifice therein, comprising the steps of:

positioning said two components such that their respective orifices are substantially aligned;

inserting a fastening device within said joined orifices, said fastening device comprising a substantially elongate body member provided with a fluid conduit, at least one protrusion means, and control means within said device controlling the movement of fluid between the exterior of said device and said conduit, thereby controlling the movement of said protrusion means;

operating said control means to admit fluid into said conduit such that said protrusion means extends substantially transversely of said body member, whereby said components become substantially fastened.

10. The method of claim 9 performed with a fastening device in which the control means comprises a one-way valve admitting fluid into the conduit, but blocking egress thereof, said operating step comprising introducing pressurized fluid so as to be admitted by said one-way valve.

* * * * *